United States Patent [19]

Anthony et al.

[11] Patent Number: 5,023,981

[45] Date of Patent: Jun. 18, 1991

[54] BELT BUCKLE WITH INTERLOCKING DUAL TONGUE

[75] Inventors: James R. Anthony, Carmel; Michael A. Wiseman, Indianapolis; Allan R. Lortz, Carmel, all of Ind.

[73] Assignee: Indiana Mills & Manufacturing, Inc., Westfield, Ind.

[21] Appl. No.: 370,240

[22] Filed: Jun. 22, 1989

[51] Int. Cl.[5] ..... A44B 11/25

[52] U.S. Cl. ..... 24/573.5; 24/632; 24/642

[58] Field of Search ..... 24/574, 642, 632, 639, 24/652, 656, 199, 200; 297/481

[56] References Cited

U.S. PATENT DOCUMENTS

| | | | |
|---|---|---|---|
| 2,461,785 | 2/1949 | Sullivan | 24/574 |
| 3,491,414 | 1/1970 | Stoffel | 24/632 |
| 3,523,342 | 8/1970 | Spires | 24/632 |
| 3,534,448 | 10/1970 | Hughes | 24/574 |
| 4,128,924 | 12/1978 | Happel et al. | 24/642 |
| 4,374,449 | 2/1983 | Stephenson et al. | 24/656 |
| 4,425,688 | 1/1984 | Anthony et al. | 24/656 |
| 4,610,058 | 9/1986 | Stemmildt et al. | 24/574 |
| 4,617,705 | 10/1986 | Anthony et al. | 24/642 |
| 4,809,410 | 3/1989 | Van Riesen | 24/574 |

FOREIGN PATENT DOCUMENTS

| | | | |
|---|---|---|---|
| 1328405 | 4/1963 | France | 24/656 |

*Primary Examiner*—Victor N. Sakran

*Attorney, Agent, or Firm*—Woodard, Emhardt, Naughton Moriarty & McNett

[57] ABSTRACT

A seat belt buckle with a pair of buckle tongues. The buckle includes a spring mechanism slidably movable within the buckle housing from a position blocking engagement of a latch when a single tongue is inserted to a position away from the latch when both tongues are inserted allowing the latch to engage the tongues. An indicator is slidably mounted to the buckle push button in the buckle cover and includes a lower end contacting the latch. The indicator is movable from a position flush with the buckle push button when the latch is not engaged with the tongues to an upraised position over the button when the latch moves up and engages the tongues. The tongues have mating portions, but are separable.

12 Claims, 3 Drawing Sheets

BELT BUCKLE WITH INTERLOCKING DUAL TONGUE

BACKGROUND OF THE INVENTION

A seat belt buckle devised to maximize holding caPability as well as to improve the cost and ease of manufacture is disclosed in the U.S. Pat. No. 4,617,705 issued to James R. Anthony and Allan R. Lortz. The buckle includes a reinforcement plate mounted to and between an upper and lower housing containing a spring biased pawl engageable with a seat belt tongue. The pawl is held captive between the lower housing and the reinforcement plate, and is biased upwardly against the plate by a pair of springs. A push button is slidably mounted to the upper housing and has a pair of legs extending downwardly through the plate to contact and move the pawl downwardly to disengage the pawl from the tongue. An additional spring mounted between the push button and reinforcement plate requires force above a predetermined level to move the button downwardly and to disengage the pawl from the tongue. In many cases, the seat belt tongue is split into two separate tongues for attachment respectively to a seat belt and a shoulder harness. It is desirable to provide such a belt buckle having a pair of tongues interlockable together, but easily separable to facilitate disengagement of the belt and harness with the user.

False latching between a belt buckle and associated tongue must be avoided. In the case of a belt buckle engageable with a pair of tongues, the buckle must be designed so that it will not lockingly engage when only a single tongue is inserted into the buckle. We have therefore devised a belt buckle which will lockingly engage the tongues only when both tongues are fully inserted therein. To prevent the user from erroneously believing the buckle is securely latched when actually the buckle is not fully engageable with both tongues, we have provided an indicator or flag centrally located on the buckle push button which extends upwardly above the button when the buckle is fully and securely engaged with the tongues. Likewise, the tongues are designed to releasably lock together prior to insertion, but which are easily separable to facilitate disengagement of the user from the seat belt and shoulder harness.

When utilizing a pair of tongues in combination with a buckle, it is easy to insert one or more of the tongues in an incorrect manner. For example, a tongue could be inserted upside down thereby causing twists in the seat belt or shoulder harness. We have therefore designed the interface between the tongues and buckle to allow insertion of the tongues only in the correct manner.

SUMMARY OF THE INVENTION

One embodiment of the present invention is a belt buckle-tongue combination comprising a buckle main body, a tongue insertable into and releasable lockable with the buckle main body, a latch positioned in the main body and held captive therein, the latch movable between a latched position with the tongue and an unlatched position, a spring and operator operably associated with the latch to move the latch back and forth between the latched position and the unlatched position, a cover mounted to the main body, and, an indicator movably mounted to the cover operable to move to a first indicating position when the latch is in the latched position and to move to a second position when the latch is in the unlatched position.

Another embodiment of the present invention is a belt buckle comprising a tongue of elongate shape, a buckle main body having a cavity therein to slidably receive the tongue, a movable latch mounted in the body for engaging the tongue inserted in the body, a manual operator accessible at the exterior of the body and engaged with the latch being movable to move the latch relative to the tongue, a first spring being operable to normally apply force against the movable latch to move same into engagement with the tongue when inserted into the body in a first condition but yieldable to allow movement of the movable latch away from the tongue, and, a false latching device movably mounted in the body and contactable and moved by the tongue when inserted into the body, the false latching device being operable to allow the latch to lockingly engage the tongue when the tongue is in a first condition and inserted into the body and further operable to hold the latch from locking engagement with the tongue when the tongue is in a second condition.

A further embodiment of the present invention is a pair of tongues lockingly engageably with a belt buckle comprising, a first tongue including a first main body with an elongated first member extending therefrom in a first direction and insertable into a buckle and further including an aperture through which a first web may be mounted, the first main body including a first overhanging portion extending therefrom, and, a second tongue including a second main body with an elongated second member extending therefrom in the first direction and insertable into the buckle and further including a second aperture through which a second web may be mounted, the second main body including a second surface releasably engageable with the first overhanging portion releasable locking the second tongue to the first tongue.

It is an object of the present invention to provide a new and improved seat belt buckle.

A further object of the present invention is to provide a seat belt buckle operable with a pair of tongues, but which will lockingly engage the tongues only when both are inserted therein.

A further object of the present invention is to provide a belt buckle having means for indicating when the buckle is lockingly engaged with a tongue or tongues.

Likewise, it is an object of the present invention to provide a pair of seat belt buckle tongues lockingly engageable together, but easily separable apart.

An additional object of the present invention is to provide means on a seat belt buckle and associated tongues preventing the tongues from being inserted in an erroneous manner.

Related objects and advantages of the present invention will be apparent from the following description.

DESCRIPTION OF THE PREFERRED EMBODIMENT

Figure 1:
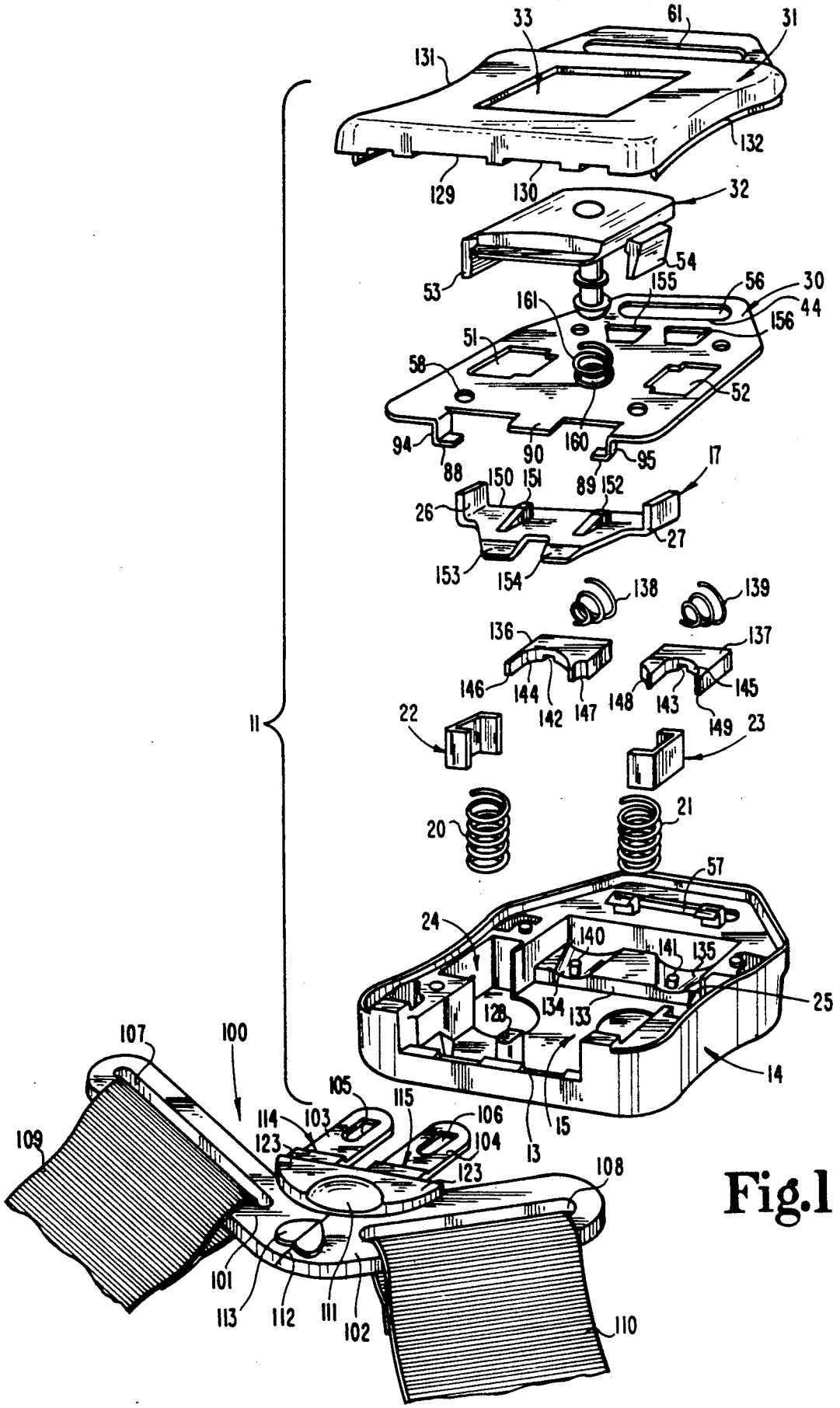
FIG. 1 is an exploded, perspective view of the buckle and tongue combination incorporating the present invention.

For the purposes of promoting an understanding of the principles of the invention, reference will now be made to the embodiment illustrated in the drawings and specific language will be used to describe the same It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a buckle tongue combination consisting of a buckle 11 shown in exploded view and a buckle tongue 100 consisting of a pair of interlocking, but separable, buckle tongues 101 and 102. Buckle 11 includes a main body 14 having a mouth 13 for receiving the leading edge of tongue 100 which extends into a cavity 15 formed in main body 14. Tongues 101 and 102 include apertures 105 and 106 through which two upraised portions 151 and 152 of pawl or latch 17 project. Tongues 101 and 102 include second apertures 107 and 108 with webs 109 and 110 extending therethrough. The two webs may represent a seat belt and harness shoulder web. A pair of helical springs 20 and 21 rest within cavity 15 and urge latch 17 to the upward position whereat the latch is locked to tongue 100. A pair of channels 23 are secured within complementarily sized cavities 24 and 25 opening into main cavity 15. Channels 22 and 23 slidably receive the mutually opposed and upturned arms 26 and 27 of latch 17. The forward edge of latch 17 is split into a pair of legs 153 and 154 having an upper surface beveled downwardly to guide tongues 101 and 102 toward the upraised portions 151 and 152 of the latch which are extendable through apertures 105 and 106. Springs 20 and 21 are positioned between the bottom wall of main body 14 forming cavity 15 and the undersurface of latch 17. A reinforcement plate 30 is attached to main body 14 and in turn is attached to cover 31 with a push button 32 located between cover 31 and plate 30 and projectable partially through aperture 33 of cover 31 to allow the operator to depress the button thereby depressing latch 17 to the downward or unlocked position. Button 32 includes lateral extensions positioned beneath cover 31 preventing the button from escaping the buckle described in U.S. Pat. No. 4,617,705 herewith incorporated by reference. Button 32 also includes legs 53 and 54 which contact the upper surface of the latch immediately inward, respectively, of arms 26 and 27 once the button is pushed sufficiently downward to unlatch the tongues. Helical spring 161 is positioned between button 32 and plate 30 surrounding sleeve 160 and is operable to force the button upwardly, but yieldable to allow the button to be depressed thereby releasing the latch from the tongues. Spring 161 increases the positive force required to depress button 32.

Main body 14 and cover 31 may be made from a material such plastic and have side recess 131 and 132 formed therein. The pair of helical springs 20 and 21 rest on the upwardly facing surface of the bottom wall of main body 14 and contact the bottom surface of latch 17. Optional pins may be used to secure the main body 14 to cover 31 and extend upwardly through plate 30. A circumferentially extending channel may be formed in the upper edge portion of main body 14 to receive the edge of reinforcement plate 30 and a downwardly extending lip of cover 31 with the lip extending in a force fit relationship between the edge of reinforcement plate 30 and the top edge of cover 14, all as shown and described in U.S. Pat. No. 4,617,705.

Figure 7:
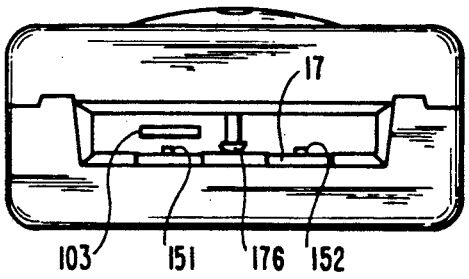
FIG. 7 is an end view of the buckle of FIG. 1 showing a single tongue inserted therein.
Figure 8:
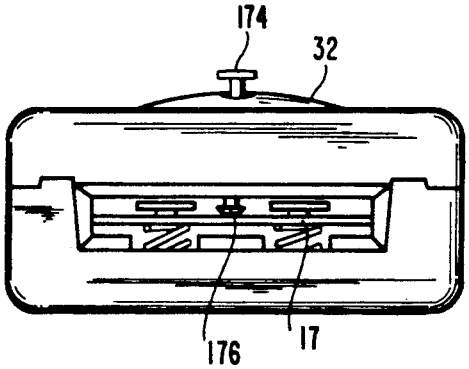
FIG. 8 is the same view as FIG. 7 only showing a pair of tongues inserted into the buckle.

Plate 30 has a forward edge with a pair of downwardly extending legs 94 and 95 in turn having, respectively, inwardly extending portions 88 and 89. Legs 94 and 95 are perpendicularly arranged to the plate and the distal ends which are parallel to the plate. The legs contact the upwardly facing surface of the bottom wall of housing 14 and support the plate thereatop. The legs are formed from the leading edge of the plate leaving a center portion 90 positioned therebetween which contacts an upwardly extending boss 128 integrally formed with the bottom housing 14. Boss 128 extends upwardly to a downwardly extending projection of cover 31 dividing the mouth into a pair of mouths to receive the forwardly extending portions 103 and 104 of tongues 101 and 102. Boss 128 has not been shown in FIGS. 7 and 8 to enable a better depiction of the indicator bottom end.

Plate 30 includes a pair of apertures 51 and 52 aligned with cavities 24 and 25 to receive the downwardly extending button legs 53 and 54 which project through the plate and movable against the top surface of the latch. A third aperture 56 is formed rearwardly of edge 44 and is aligned with aperture 57 of main body 14 and a similarly located aperture 61 of cover 31 to allow a seat belt to be attached to the buckle. A plurality of apertures 58 are located around the peripheral portion of plate 30 to receive the pins which extend through the plate and into the main body 14 and cover 13 to provide additional strengthening means securing the cover plate and main body together.

Figure 6:
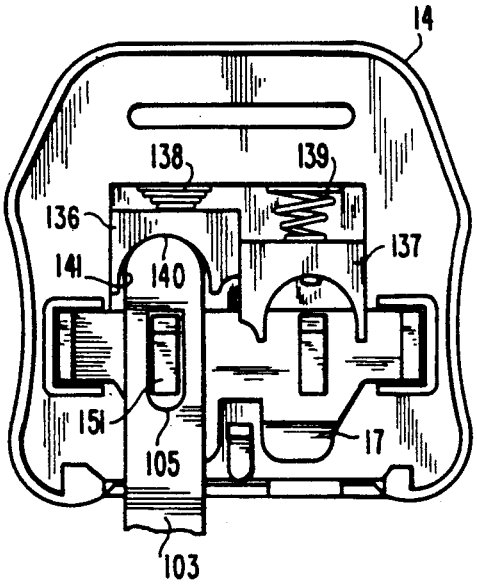
FIG. 6 is the same view as FIG. 5 only showing a single tongue inserted into the buckle.

A pair of concave cavities 134 and 135 are formed in the aft portion of cavity 15 being separated by an upraised portion 133 to receive a pair of horizontally extending wire springs 138 and 139. Both cavities 134 and 135 are tapered so that the smaller end of the cavities face forward to receive the complementary shaped tapered ends of wire springs 138 and 139. To insure the buckle will latch only when both tongues are inserted therein, a pair of plastic anti-false latching members 136 and 137 are provided within cavity 15 being located between the rear edge 150 of latch 17 and the forward ends of springs 138 and 139. Members 136 and 137 have forwardly opening concave surfaces 144 and 145 to respectively engage the rounded distal ends of tongue bars 103 and 104. Each member 136 and 137 has a downwardly opening cavity 142 and 143 to receive, respectively, pins 140 and 141 which project upwardly from the bottom of cavity 15 thereby mountingly holding members 136 and 137 within the cavity. Each cavity 142 and 143 opens through, respectively, surfaces 144 and 145 to allow members 136 and 137 to slide horizontally backward compressing springs 138 and 139 when the tongues are fully inserted thereby contacting the surfaces 144 and 145. Likewise, when the tongue bars are withdrawn from the buckle, springs 138 and 139 force members 136 and 137 horizontally in the direction of the mouth of the buckle. Members 136 and 137 each have an outwardly located side extension 146 and 149 and center extensions 147 and 148 which normally project above the upper surface of latch 17 when tongue bars 103 and 104 are not inserted into the buckle. In the event a single tongue bar is inserted into the buckle, only a single member 136 or 137 moves rearwardly thereby allowing the remaining unmoved member to project over the latch and prevent the latch from engaging the inserted tongue bar. For example, in the event tongue bar 103 is inserted into cavity 15 while tongue bar 104 remains outwardly of the buckle, the rounded distal end 140 (FIG. 6) of tongue bar 103 will engage the downwardly beveled leg 153 of the latch eventually positioning aperture 105 immediately over projection 151. Simultaneously, tongue bar 103 will engage concave surface 144 and move member 136 rearwardly thereby moving projections 146 and 147 away from latch 17. Projections 148 and 149 of member 137, however, will remain above latch 17 preventing the latch from moving upwardly by the force of helical springs 20 and 21 and thereby preventing upraised latch portion 151 from entering opening 105. The upper edge 141 (FIG. 6) of concave surface 146 is located above the top surface of tongue bar 103.

Figure 4:
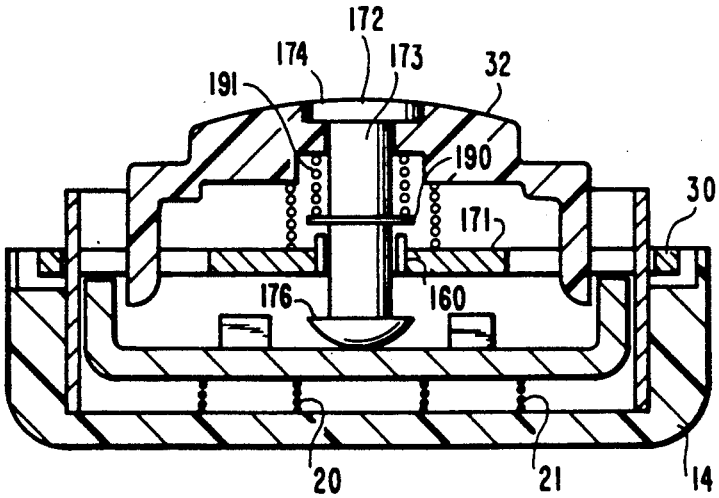
FIG. 4 is a cross-sectional view of the buckle of FIG. 1 with the upper housing removed therefrom.
Figure 5:
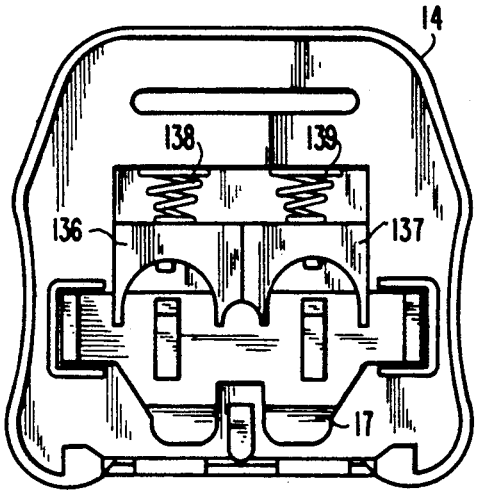
FIG. 5 is a top view of the buckle of FIG. 1 only with the reinforcement plate and portions thereabove removed to illustrate the position of the pawl.

The buckle push button is provided with an indicator for clearly illustrating when the buckle is lockingly engaged with both tongues. The central portion of button 32 (FIG. 4) is provided with a counter bored hole to receive indicator 172. The stem 173 of the indicator extends freely through button 32 and has a head 174 integrally formed thereon which is complementarily received in the counter bore recess of the button aperture. The upper surface of head 174 is smoothly contoured to blend into the convex upwardly facing surface of button 32 when the button is in the retracted position corresponding to indicating the buckle is not lockingly engaged with both tongues. Stem 173 extends through a upwardly projecting sleeve 160 (FIG. 1) fixedly mounted to the center portion of upwardly facing surface 171 of reinforcement plate 30. Stem 173 projects through sleeve 160 and the reinforcement plate towards latch 17. An enlarged rounded bottom end 176 is mounted to stem 173. A projection, such as a washer 190 is fixedly mounted to stem 173 supporting a helical spring 191 thereatop which has a top end engaging the bottom surface of button 32. Spring 191 is operable to urge button head 174 downwardly into the button counter bored recess, but is yieldable to allow the head 174 to extend above the button 32 once latch 17 moves upwardly to the latched condition thereby forcing bottom end 176 of the indicator upwardly. End 176 is larger than the inside diameter of sleeve 160 to prevent the indicator from escaping the buckle and may be affixed to stem 173 once the stem is inserted through sleeve 160. Center projections 147 and 148 (FIG. 1) have distal concave shaped ends forming a partial semicircular cavity to prevent any interference with bottom end 176 of the indicator. A pair of apertures 155 and 156 (FIG. 1) are provided to prevent interference between the plate, helical springs 138 and 139 and upraised latch portions 151 and 152.

When the tongue bars 103 and 104 are not inserted into the buckle, the top surface of indicator head 174 is flush with the upwardly facing surface of button 32. Once both tongue bars 103 and 104 are inserted into the buckle and are lockingly engaged with upraised latch portions 151 and 152, latch 17 moves to the upward position (FIG. 8) compressing spring 191 and moving stem 173 upward until head 174 projects above the upwardly facing surface of button 32. An indication is therefore provided that the buckle is lockingly engaged with the buckle tongues. To disengage the buckle with the tongues, buckle 32 is moved downwardly thereby forcing latch 17 downwardly disengaging the upraised latch portions with the tongue bars.

Buckle tongue 100 consists of two interlockable, but separable tongues 101 and 102 each having fixedly mounted thereto in cantilevered fashion tongue bars 103 and 104. Tongue bars have respectively D-shaped apertures 105 and 106 with the flat portion of the D-shaped hole being located adjacent the rounded distal ends of the tongue bar to engage the upraised latch portions 151 and 152. Tongue bars 103 and 104 are provided with upraised portions 114 and 115 adjacent their proximal ends with the upraised portions 114 and 115 being complementarily shaped to fit into, respectively, recesses 129 and 130 formed in the top cover 31. Thus, if the tongue bars 103 and 104 are turned upside down, then upraised portions 114 and 115 will not fit into recesses 129 and 130, and instead will contact the outwardly facing surface of housing 14 adjacent the buckle mouth preventing full insertion of the tongue bars and thereby preventing engagement of recesses 105 and 106 with upraised latch portions 151 and 152.

Tongues 101 and 102 (FIGS. 2 and 3) have overlapping walls 117 and 116, respectively, which extend over and adjacent the other tongue. For example, tongue 101 includes wall 117 which extends outwardly of and adjacent tongue 102, whereas wall 116 integrally attached to tongue 102 extends outwardly and adjacent tongue 101. Walls 116 and 117 are provided, respectively, with projections 118 and 119 which fit into complementarily sized apertures provided in the outwardly facing surface of each tongue. For example, tongue 101 includes aperture 120 which releasably receives projection 118 of wall 116. Likewise, projection 119 which extends upwardly from surface 121 of wall 117 extends into an aperture provided in the downwardly facing surface of tongue 102 as viewed in FIG. 2.

Figure 2:
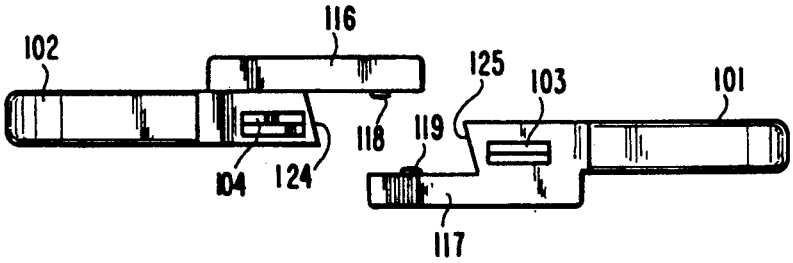
FIG. 2 is an end view of the tongue of FIG. 1 only showing the tongue separated into a pair of tongues.
Figure 3:
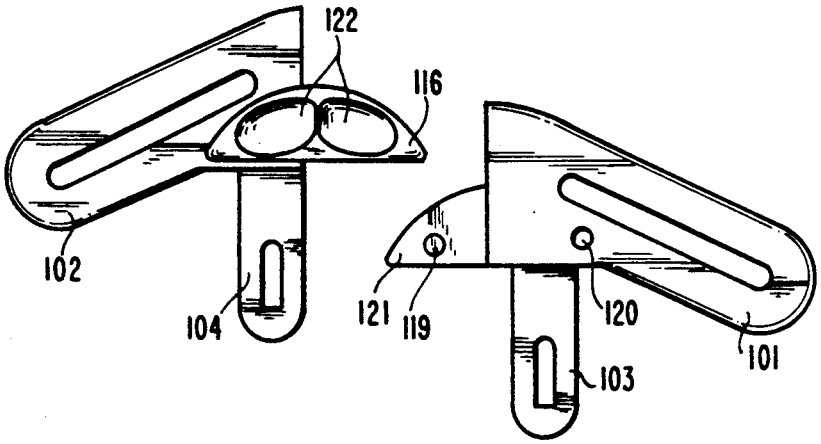
FIG. 3 is a top view of the tongues shown in FIG. 2 with the tongues being separated to fully illustrate the interlocking end portions.

The mutually facing surfaces 124 and 125 of tongues 102 and 101 are at an angle relative to the vertical axis as shown in FIG. 2 facilitating the sliding together of the tongues and the eventual extension of projections 118 and 119 into the adjacent apertures provided in the tongues.

Wall 116 integrally attached to tongue 102 has a downwardly facing surface with a pair of finger depressions 122. Likewise, wall 117 attached to tongue 101 has an upwardly facing surface 123 (FIG. 1) with a single thumb depression 111 formed therein enabling the user to grasp the pair of tongues by placing the user's thumb in depression 111 and the second and third fingers of the hand in depressions 122. A heart-shaped upraised portion 113 is formed on the upper surface of tongues 101 and 102 to provide an indication of which side of the tongues should face upwardly. Upraised portion 113 is divided in half along the tongue mating line 112 which is aligned with mating surfaces 124 and 125 of the tongues.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A belt buckle-tongue combination comprising:

a buckle main body;

tongue means insertable into and releasable lockable with said buckle main body;

a latch positioned in said main body and held captive therein, said latch movable between a latched position with said tongue means and an unlatched position;

a push button slidably mounted to said buckle main body and operable associated with said latch to move said latch back and forth between said latched position and said unlatched position; and, an indicator slidably mounted to said buckle main body, said indicator being an element separate from said push button and movable independently of said push button, said indicator in contact with said latch and movable to a first indicating position when said latch is in said latched position and to move a second position when said latch is in said unlatched position thereby said indicator readily reveals when said tongue means is lockingly engaged with said buckle main body.

2. The combination of claim 1 wherein:

said indicator includes an elongated device with a first end engaged with said latch and an opposite end movable outwardly only when said tongue means is inserted into and locked with said main body.

3. A belt buckle-tongue combination comprising:

a buckle main body;

tongue means insertable into and releasable lockable with said buckle main body:

a latch positioned in said main body and held captive therein, said latch movable between a latched position with said tongue means and an unlatched position;

first means externally accessible and operable associated with said latch to move said latch back and forth between said latched position and said unlatched position;

movable mounted indicating means operable to move a first indicating position when said latch is in said latched position and to move to a second position when said latch is in said unlatched position;

said indicating means includes an elongated device with a first end engaged with said latch and an opposite end movable outwardly only when said tongue means is inserted into and locked with said main body, said elongated device being an element separate from said first means and movable independently thereof; and said main body includes a housing and a cover mounted to said housing and further includes a push button slidably mounted to said cover and operably associated with said latch, said cover and said main body form a tongue receiving cavity with said latch projecting into said cavity to lock said tongue means inserted therein.

4. A belt buckle-tongue combination comprising:

buckle tongue means of elongate shape, said tongue means including a pair of tongues including a first tongue having a first elongated member with a first distal end and a first proximal end portion with a first opening located therebetween, said tongue means further including a second tongue having a second elongated member with a second distal end and a second proximal end portion with a second opening located therebetween, said first tongue and said second tongue are interlockable together although said first elongated member and said second elongated member are spaced apart and are in the same plane;

a buckle main body having a cavity therein to slidably receive both said first elongated member and said second elongated member;

a movable latch mounted in said body for separately engaging said first elongated member and said second elongated member inserted in the body, said latch including a first locking projection and a second locking projection movable simultaneously respectively through said same plane and through said first opening and said second opening and lockable directly with said first tongue and said second tongue only when said first elongated member and said second elongated member are spaced apart and are positioned within said buckle main body providing a direct locking engagement between said latch and each tongue;

manual operating means accessible at the exterior of the body and engaged with said latch being movable to move said latch relative to said first elongated member and said second elongated member;

first spring means being operable to normally apply force against said movable latch to move same into engagement with said first elongated member and said second elongated member when inserted into the body in a first condition but yieldable to allow movement of said movable latch away from said first elongated member and said second elongated member; and, false latching means movably mounted in said body and contactable and moved by said first elongated member and said second elongated member when inserted into said body, said false latching means being operable to allow said latch to lockingly engage said first elongated member and said second elongated member when said first elongated member and said second elongated member are in a first condition and inserted into said body and further operable to hold said latch from locking engagement with said first elongated member and said second elongated member when said first elongated member and said second elongated member are in a second condition.

5. The buckle of claim 6 wherein:

said first tongue and said second tongue are interlockable together when in said first condition but are separated apart when in said second condition; and said false latching means contacts and holds said latch from locking engagement when only one of said tongues is inserted into said main body.

6. The buckle of claim 7 wherein: said false latching means includes a first slide, a second slide, and slide spring means with said slide spring means normally urging said first slide and said second slide against said latch but yieldable to allow said first slide to move away from said latch when contacted and moved by said first tongue while said second slide remains against said latch holding same away from locking engagement until contacted and moved by said second tongue away from said latch allowing said latching means to move into locking engagement with said first tongue and said second tongue.

7. The buckle of claim 8 wherein:

said first slide and said second slide include projections movable over and against said latch by said slide spring means and further include concave surfaces contactable by said first tongue and said second tongue.

8. The buckle of claim 9 wherein:

said main body includes a pair of pegs upon which said first slide and said second slide are mounted.

9. The buckle of claim 6 and further comprising:

indicating means movably mounted to said body operable to move to a first indicating position when said latch is in a latched position and to move to a second position when said latch is in an unlatched position, said indicating means is movable independently of said manual operating means.

10. The buckle of claim 11 wherein:

said indicating means includes an elongated device with a first end engaged with said latch and an opposite end movable outwardly from said main body only when said tongue means is inserted into and locked with said main body.

11. A pair of tongues lockingly engageably with a belt buckle comprising:

a first tongue including a first main body with an elongated first member extending therefrom in a first direction and insertable into a buckle and further including an aperture through which a first web is mountable, said elongated first member including a first latch engageable opening;

a second tongue including a second main body with an elongated second member extending therefrom in said first direction and insertable into said buckle and further including a second aperture through which a second web is mountable, said first tongue and said second tongue are interlockable together although said elongated first member and said elongated second member are spaced apart and contained in a single plane, said elongated second member including a second latch engageable opening which together with said first latch engageable opening allowing direct and separate latch engagement with said elongated first member and said elongated second member.

12. A pair of tongues lockingly engageably with a belt buckle comprising:

a first tongue including a first main body with an elongated first member extending therefrom in a first direction and insertable into a buckle and further including an aperture through which a first web may be mountable, said first main body including a first overhanging portion extending therefrom; and a second tongue including a second main body with an elongated second member extending therefrom in said first direction and insertable into said buckle and further including a second aperture through which a second web may be mountable, said second main body including a second surface means releasably engageable with said first overhanging portion releasable locking said second tongue to said first tongue; and wherein;

said second main body including a second overhanging portion extending therefrom, said first main body including a first surface means releasably engageable with said second overhanging portion releasable locking said first tongue to said second tongue; said first overhanging portion and said second overhanging portion are parallel but are positioned apart on opposite sides of said first tongue and said second tongue when locked together, said first overhanging portion includes a thumb depression facing outwardly and said second overhanging portion includes a pair of finger depressions facing in an opposite direction than said thumb depression, said first surface means includes a first surface with a hole and said second overhanging portion includes a projection extendable into said hole, said second surface means includes a second surface with a second hole and said first overhanging portion includes a projection extendable into said second hole, said first main body and said second main body include parallel contactable mating surfaces extending at an angle askew to said first surface and said second surface when said first tongue and said second tongue are locked together.

* * * * *

UNITED STATES PATENT AND TRADEMARK OFFICE

CERTIFICATE OF CORRECTION

PATENT NO. : 5,023,981

DATED : June 18, 1991

INVENTOR(S) : James R. Anthony, et al.

It is certified that error appears in the above-identified patent and that said Letters Patent is hereby corrected as shown below:

In Col. 1, line 7, please change "caPability" to --capability--.

In Col. 3, line 16, please change "the same It" to --the same. It--.

In Col. 7, line 44, please change "operable" to --operably--.

In Col. 8, line 54, please change "claim 6" to --claim 4--.

In Col. 8, line 61, please change "claim 7" to --claim 5--.

In Col. 8, line 61, before the word "said' please start a new pararaph.

In Col. 9, line 5, please change "claim 8" to --claim 6--.

In Col. 9, line 11, please change "claim 9" to --claim 7--.

In Col. 9, line 14, please change "claim 6" to --claim 4--.

In Col. 9, line 21, please change "claim 11" to --claim 9--.

Signed and Sealed this

Fifteenth Day of December, 1992

*Attest:*

DOUGLAS B. COMER

*Attesting Officer*

*Acting Commissioner of Patents and Trademarks*